US006543425B2

(12) United States Patent
Mayer et al.

(10) Patent No.: US 6,543,425 B2
(45) Date of Patent: Apr. 8, 2003

(54) FUEL SUPPLY DEVICE FOR AN INTERNAL COMBUSTION ENGINE

(75) Inventors: Hanspeter Mayer, Markt Piesting (AT); Theodor Stipek, Salzburg (AT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/960,026

(22) Filed: Sep. 21, 2001

(65) Prior Publication Data

US 2002/0069856 A1 Jun. 13, 2002

(51) Int. Cl.[7] ..... F02M 37/04
(52) U.S. Cl. ..... 123/495; 123/497
(58) Field of Search ..... 123/198 D, 495, 123/497, 179.16, 179.17, 509

(56) References Cited

U.S. PATENT DOCUMENTS 4,683,854 A * 8/1987 Goulet ..... 123/478
5,201,294 A * 4/1993 Osuka ..... 123/458
5,546,912 A * 8/1996 Yamada et al. ..... 123/511
6,021,763 A * 2/2000 Yoshihara et al. ..... 123/516
6,253,739 B1 * 7/2001 Golomb ..... 123/509

OTHER PUBLICATIONS

Dieselmotor Management, Verlag Vieweg, 2. Auflage 1998, pp. 262–263.

* cited by examiner

*Primary Examiner*—Thomas N. Moulis
(74) *Attorney, Agent, or Firm*—Michael J. Striker

(57) ABSTRACT

A fuel supply device for an internal combustion engine has a supply container, at least one feed pump for supplying a fuel from the supply container, a high pressure pump to which the fuel is supplied from the supply container by the feed pump, so that the fuel is supplied under high pressure at least indirectly to injection points of an internal combustion engine, the feed pump being driven mechanically by the internal combustion engine, and a further feed pump provided additionally to the mechanically driven feed pump and supplying the fuel from the supply container to the high pressure pump, the further feed pump having an electric drive and being operable independently from the mechanically driven feed pump.

10 Claims, 2 Drawing Sheets

FUEL SUPPLY DEVICE FOR AN INTERNAL COMBUSTION ENGINE

BACKGROUND OF THE INVENTION

The present invention relates to a fuel supply device for an internal combustion engine.

Fuel supply devices of this type are disclosed for example in the publication "Dieselmotor Management", Verlag Vieweg, 2 edition 1999, pages 262–263. The fuel supply device has a feed pump which supplies the fuel from a supply container to a high pressure pump. With the high pressure pump, the fuel is supplied under high pressure at least indirectly to injection points on the internal combustion engine. The feed pump is driven mechanically by the internal combustion engine. During start of the internal combustion engine the feed pump is driven with a low rotary speed, so that the fuel quantity supplied by it in this condition is not sufficient to provide a reliable start of the internal combustion engine. In particular, at high fuel temperatures and low rotary speeds of the internal combustion engine, for example because of a not sufficient voltage of the board current source, the feed pump does not supply sufficient fuel quantity. The feed pump can be modified so that it supplies a greater fuel quantity, but in other operational conditions then the required fuel quantity will be too high and must be uselessly withdrawn.

SUMMARY OF THE INVENTION

Accordingly, it is an object of the present invention to provide a fuel supply device for an internal combustion engine, which avoids the disadvantages of the prior art.

In keeping with these objects and with others which will become apparent hereinafter, one feature of present invention resides, briefly stated, in a fuel supply device for an internal combustion engine which has a supply container, at least one feed pump for supplying a fuel from the supply container, a high pressure pump to which the fuel is supplied from the supply container by the feed pump, so that the fuel is supplied under high pressure at least indirectly to injection points of an internal combustion engine, the feed pump being driven mechanically by the internal combustion engine, and a further feed pump provided additionally to the mechanically driven feed pump and supplying the fuel from the supply container to the high pressure pump, the further feed pump having an electric drive and being operable independently from the mechanically driven feed pump.

When the fuel supply device is designed in accordance with the present invention, it has the advantage that by the electrically driven further feed pump, intentionally in the required operational conditions the fuel quantity supply by the high pressure pump is increased, so that a reliable start and a reliable operation of the internal combustion engine is guaranteed in all operational conditions.

In accordance with another feature of present invention, the mechanically driven feed pump and the further feed pump are assembled to form a feed module. Therefore a simple construction is provided.

In accordance with a further feature of present invention, the feed module has a suction connection to the supply container, through which both feed pumps aspirate fuel, a pressure connection to the high pressure pump through which both feed pumps supply fuel, and a check valve arranged between the pressure connection and the further feed pump and closing toward the further feed pump. With this construction a return flow of the fuel, which is supplied by the mechanically driven feed pump through the further feed pump into the supply container, is reliably prevented.

In accordance with another feature of present invention, the further feed pump is operated in the event of a failure of the mechanically driven feed pump. Therefore it is guaranteed that the internal combustion engine at least in an emergency situation can operate in the case of a failure of the mechanically driven feed pump.

Finally, in accordance with another feature of present invention, the further feed pump supplies a smaller fuel quantity than the maximum fuel quantity of the mechanically driven feed pump. Therefore a simple and cost favorable construction of both feed pumps can be provided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
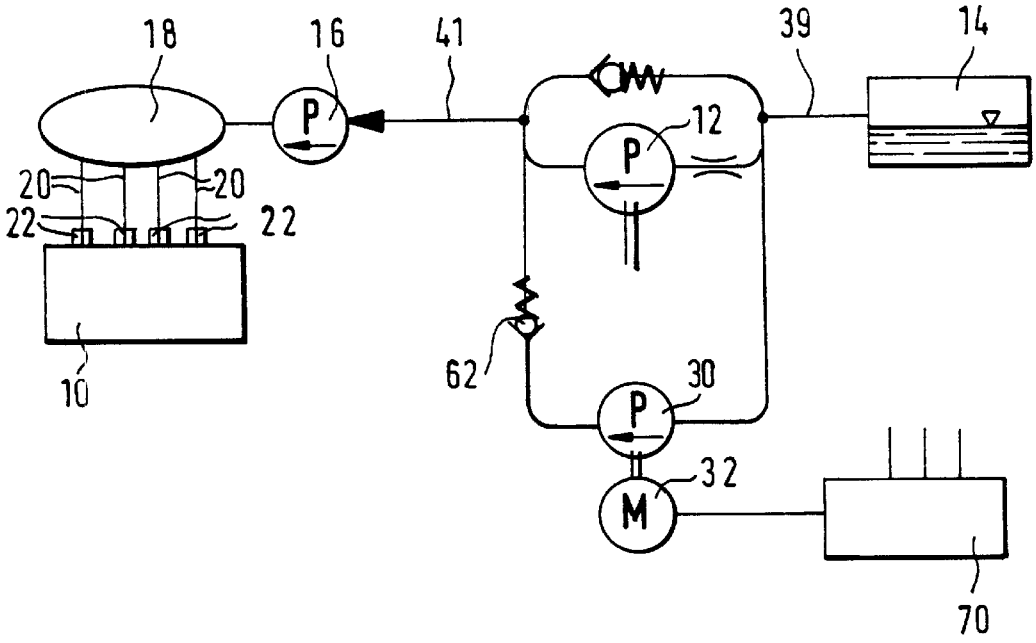
FIG. 1 is a view showing a fuel supply device for an internal combustion engine in a schematic illustration.

FIG. 1 shows a fuel supply device for an internal combustion engine 10 of a motor vehicle or a stationary internal combustion engine, which is a self-igniting internal combustion engine.

The fuel supply device has a feed pump 12 which supplies the fuel from a supply container 14. The feed pump 12 can be formed as a gear pump and can be driven mechanically by the internal combustion engine 10. The rotary speed of the feed pump 12 is proportional to the rotary speed of the internal combustion engine 10. Downstream after the feed pump 12, a high pressure pump 16 is arranged. Its suction side supplies the fuel which is displaced by the feed pump 12. High pressure storage 18 is arranged downstream of the high pressure pump 16.

Conduits 20 from the pressure storage 18 lead to injection points 22 at the cylinders of the internal combustion engine 10. Injectors are arranged at the injection points 22 and inject fuel into the combustion chambers of the cylinders of the internal combustion engine 10. Valves 21 are provided for controlling the injection of the injectors. They establish the connection of the injectors with the high pressure storage 8 or interrupt the connection. Alternatively, it can be provided that for each cylinder of the internal combustion engine 10, a high pressure pump is provided. Its suction side is connected with the feed pump 12.

Figure 2:
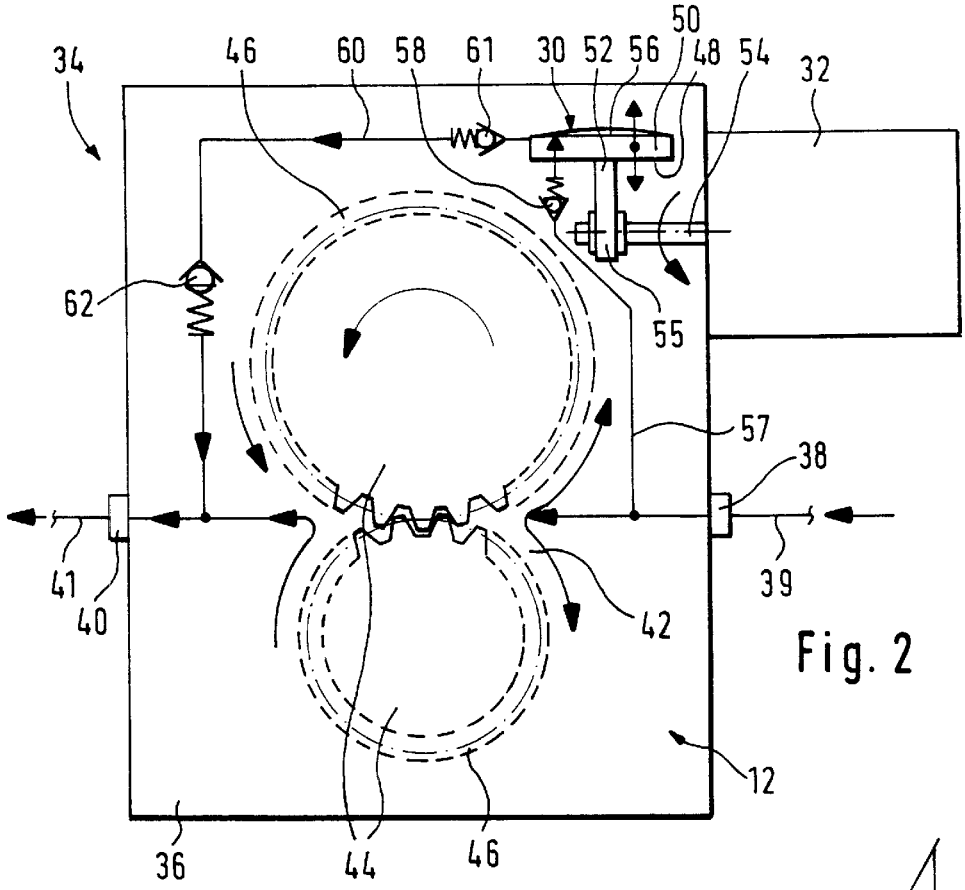
FIG. 2 is a view showing a feed module of the fuel supply device, on an enlarged scale.

In accordance with the present invention, in addition to the mechanically driven feed pump 12, a further feed pump 30 is provided. It has an electrical drive 32. The drive 32 is formed for example by a direct current electric motor, and the board current source of the motor vehicle serves as a current source. With the further feed pump 30, during its operation parallel to the mechanically driven feed pump 12, fuel is fed from the supply container 14 and supplied to the high pressure pump 16. The mechanically driven feed pump 12 and the further feed pump 30 are assembled for example to form a feed module 34. The feed module 34 is shown in FIG. 2 on an enlarged scale.

The feed module 34 has a housing 36 with a suction-side connection 38. A suction conduit 39 to the supply container 14 is connected to the connection 38. A pressure-side connection 40 is arranged moreover on the housing 36. A pressure conduit 41 for the high pressure pump 16 is connected to the connection 40. A pump chamber 42 is limited in the housing 36 for the feed pump 12. Two toothed gears 44 which engage with one another over their outer periphery are arranged as components of the feed pump 12 in the pump chamber 42. One of the toothed gears 44 is driven in a not shown manner by the internal combustion engine 10. During the operation of the feed pump 12 fuel is supplied by its rotatable toothed gears 44 along supply passages 46 which extend over their periphery, from the suction side with the suction connection 38 to the pressure side with the pressure connection 40.

The further feed pump 40 is formed for example as a diaphragm pump and has a diaphragm 50 arranged in the housing 36 in a further pump chamber 48. The diaphragm 50 is connected with a plunger 52 which is driven by the electric motor 32 in a stroke movement. The electric motor 32 can be arranged in the housing 36 or, as shown in FIG. 2, outside of the housing 36. A shaft 54 of the electric motor 32 extends in the housing 36 and is coupled with the plunger 52 by an eccentric 55, so that during rotary movement of the shaft 54 the plunger 52 is driven in the stroke movement. The stroke movement of the plunger 52 is transmitted to the diaphragm 50. A pump working chamber 56 is limited by the diaphragm 50 in the pump chamber 48. It communicates with the suction connection 38 through the connection 57 extending in the housing 36 for example in form of an opening or a channel. A check valve 58 which opens into the pump working chamber 56 is arranged in the connection 57 and opens during a suction stroke of the diaphragm 50, so that fuel can be supplied from the suction connection 38 into the pump work chamber 56.

The pump work chamber 56 is also connected with the pressure connection 40 through a connection 60 which extends in the housing 36, and can be also formed as an opening or a passage. A check valve 61 which opens toward the pressure connection 40 is arranged in the connection 60. During the forward stroke of the diaphragm 50 the check valve 58 closes and the check valve 61 opens, so that fuel is displaced from the pump work 56 to the pressure connection 40. The check valve 61 is preferably arranged in the connection 60 near the pump work chamber 56. The plunger 52, the diaphragm 50 as well as the check valves 58 and 61 together with a housing part which receives these elements, can form a structural unit which is insertable into the housing 36 of the feed module 34. A further check valve 62 can be arranged in the connection 60 of the pump work chamber 56 with the pressure connection 40 near the pressure connection 40, so as to open toward the pressure connection 40 and to close toward the pump work chamber 56. The check valve 62 prevents that the fuel supplied by the feed pump 12 can be displaced by the connection 60 in the pump work chamber 56 to the further feed pump 30.

The operation on the further feed pump 30 is controlled for example by an electronic control device 70, by which for example also the injection of the fuel with the injectors is controlled. The control device 70 supplies signals about the operational condition of the internal combustion engine 10, in particular its rotary speed, load, cooling medium temperature, fuel temperature and in some cases further parameters. With the control device 70 the further feed pump 30, is set in operation, in particular at low rotary speed and or at high cooling medium and/or fuel temperature. A low rotary speed of the internal combustion engine 10 occurs for example during starts, so that the further feed pump 30 is driven by the control device 70 during starts of the internal combustion engine 10 when the feed pump 12, because of the low rotary speed of the internal combustion 10, is also driven with a low rotary speed.

It can be provided that the further feed pump 30 is set in operation by the control device 70 before the start of the internal combustion engine 10, so that the high pressure pump 16 is supplied with fuel prematurely. Thereby a good lubrication of the high pressure pump 16 is provided. It can be for example provided that the control device 70 supplies a signal about closing of the doors of the motor vehicle, or about the insertion of the ignition key into the ignition lock, or about the rotation of the ignition key in an ignition position, or a seat occupation recognition, and in this case sets the further feed pump 30 in operation. When the internal combustion engine 10 reaches a sufficiently high rotary speed, for example the orderly idle running rotary speed, then the control device 70 switches off the further feed pump 10 so that when only the feed pump 12 supplies fuel to the high pressure pump 16.

It can be also provided that in the case of a failure of the feed pump 12, when the internal combustion engine 10 can no longer be operated, the control device 70 sets the further feed pump 30 in operation. Thereby a sufficient fuel quantity is supplied to the high pressure pump 16, in order to provide at least an emergency operation of the internal combustion engine 10 with a low power. Moreover, it can be provided that the further feed pump 30 is set in operation after the supply container 14 is completely emptied and is subsequently again filled. Thereby a ventilation and filling of the conduits 39 and 41 of the high pressure pump 16 is provided, so that during a subsequent start of the internal combustion engine 10 they are filled with fuel and the starting process can be shortened.

Figure 3:
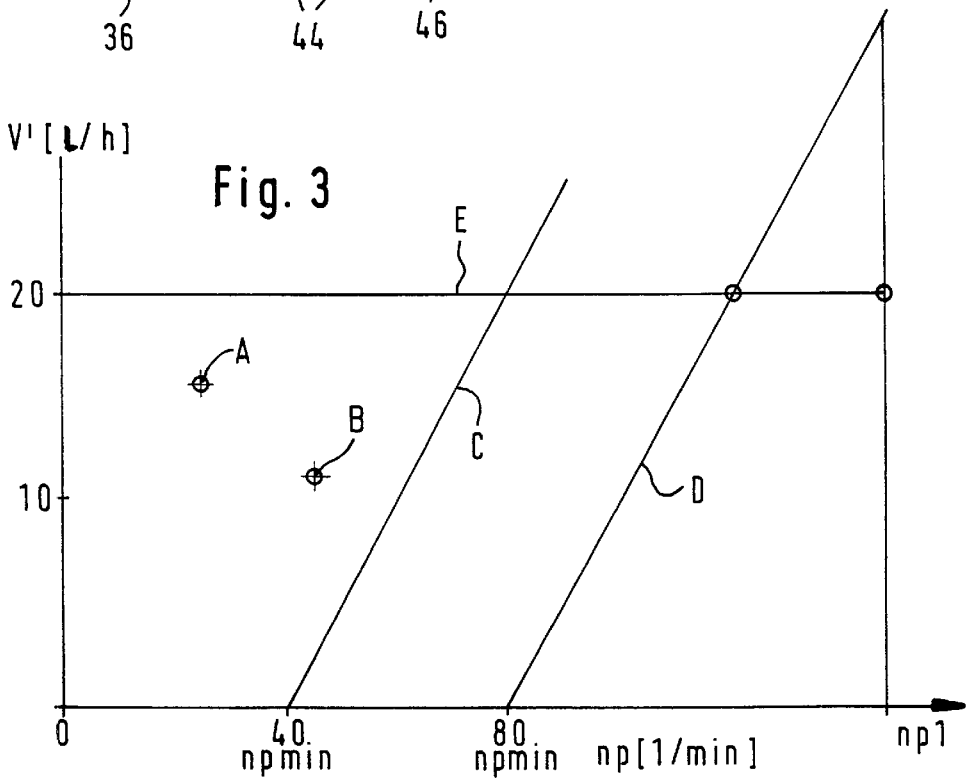
FIG. 3 is a view showing a characteristic field of the fuel quantity supplied by the feed pumps of the feed module, depending on a rotary speed.

FIG. 3 shows a characteristic field of a fuel supply quantity over the rotary speed of the feed pump 12, wherein the numerical values are only exemplary. The high pressure pump 16 at a fuel temperature of approximately −20° C. has a fuel consumption marked with the point A, and at the fuel temperature of approximately +90° C. has the fuel consumption marked with the point B. In FIG. 3 a characteristic line of the feed pump 12, or in other words the feed quantity V' over the pump rotary speed np, at the fuel temperature of approximately −20° C. is plotted and identified with C. A further characteristic line for a fuel temperature of approximately +90° C. is plotted and identified with D. It can be seen from FIG. 3 that the fuel supply by the fuel pump 12 is first started from a predetermined minimum rotary speed np min of the fuel pump 12 and increases with increasing fuel temperature. With increasing rotary speed np the fuel pump 12 increases the fuel quantity V'. In FIG. 3 moreover a characteristic line of the further feed pump 30 is plotted, which is identified with E. The characteristic line E of the further fuel pump 30 extends approximately horizontally since the further feed pump 30 is driven with a constant rotary speed and not as the feed pump 12 with a rotary speed which is proportional to the rotary speed of the internal combustion engine 10. When the feed pump 12 reaches such a high rotary speed np 1 that by it a sufficiently great fuel quantity V' is supplied, the further feed pump 30 is switched off.

The fuel quantity supplied by the further feed pump 30 is substantially smaller than the maximum fuel quantity supplied by the feed pump 12. The supply quantity of the further fuel pump 30 can amount to, for example, approximately between 3% and 20% of the maximum supply quantity of the feed pump 12. The further feed pump 30 is operated correspondingly only for a short time period, so that it suffices to design it for a relatively short service life, which makes possible a cost-favorable manufacture. With the use of the further feed pump 30, the feed pump 12 can be produced in a simple manner, since high manufacturing tolerances can be accepted for it. Such high manufacturing tolerances, in particular at low pump rotary speeds worsen the supply power, which however is compensated by the supply power of the further feed pump 30. The further feed pump 30 can be formed also as a separate unit with respect to the feed pump 12. Moreover, the further feed pump 30 can be arranged before the feed pump 12 and connected in series to the supply container 14.

It will be understood that each of the elements described above, or two or more together, may also find a useful application in other types of constructions differing from the types described above.

While the invention has been illustrated and described as embodied in fuel supply device for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A fuel supply device for an internal combustion engine, comprising a supply container; at least one feed pump for supplying a fuel from said supply container; a high pressure pump to which said fuel is supplied from said supply container by said feed pump, so that the fuel is supplied under high pressure at least indirectly to injection points of an internal combustion engine; said feed pump being driven mechanically by the internal combustion engine; and a further feed pump provided additionally to said mechanically driven feed pump and supplying the fuel from said supply container to said high pressure pump, said further feed pump having an electric drive and being operable independently from said mechanically driven feed pump.

2. A fuel supply device as defined in claim 1, wherein said mechanically driven feed pump and said further feed pump supply the fuel parallel to one another from said supply container to said high pressure pump.

3. A fuel supply device as defined in claim 1, wherein said mechanically driven feed pump and said further feed pump are assembled to form a feed module.

4. A fuel supply device as defined in claim 3, wherein said feed module has a suction connection to said supply container, through which both said pumps aspirate the fuel, a pressure connection to said high pressure pump through which both said feed pumps supply fuel, and a check valve arranged between said pressure connection and said further feed pump and closing toward said further feed pump.

5. A fuel supply device as defined in claim 1; and further comprising an electronic control device which controls an operation of said further feed pump.

6. A fuel supply device as defined in claim 5, wherein said electronic control device is formed so that it operates said further feed pump at a time selected from the group consisting before a start of the internal combustion engine, after a start of the internal combustion engine, and both.

7. A fuel supply device as defined in claim 5, wherein said control device is formed so that said further feed pump is operated in the case of a failure of said mechanically feed pump.

8. A fuel supply device as defined in claim 1, wherein said further feed pump is formed as a diaphragm pump.

9. A fuel supply device as defined in claim 1, wherein said further feed pump supplies a lower feed quantity than a maximum feed quantity supplied by said mechanically driven feed pump.

10. A fuel supply device as defined in claim 9, wherein said further feed pump supplies a fuel quantity which amounts to approximately 3–20% of a maximum supply quantity of said mechanically driven feed pump.

* * * * *